US012790046B2

(12) United States Patent
Ng et al.

(10) Patent No.: US 12,790,046 B2
(45) Date of Patent: Nov. 10, 2026

(54) RAPID BAG FILLING SYSTEM

(71) Applicant: Automated Systems of Tacoma, LLC, Tacoma, WA (US)

(72) Inventors: Steven Ng, Kent, WA (US); Michael Moore, Gig Harbor, WA (US)

(73) Assignee: Automated Systems of Tacoma, LLC, Tacoma, WA (US)

( * ) Notice: Subject to any disclaimer, the term of this patent is extended or adjusted under 35 U.S.C. 154(b) by 0 days.

(21) Appl. No.: 19/534,512

(22) Filed: Feb. 9, 2026

(65) Prior Publication Data

US 2026/0167366 A1 Jun. 18, 2026

Related U.S. Application Data

(63) Continuation of application No. 18/959,481, filed on Nov. 25, 2024, now Pat. No. 12,545,449.

(60) Provisional application No. 63/602,869, filed on Nov. 27, 2023.

(51) Int. Cl.

| | |
|---|---|
| ***B65B 3/00*** | (2006.01) |
| ***B65B 3/04*** | (2006.01) |
| ***B65B 7/02*** | (2006.01) |
| ***B65B 43/12*** | (2006.01) |
| ***B65B 43/14*** | (2006.01) |

(52) U.S. Cl.

CPC ..... *B65B 3/003* (2013.01); *B65B 3/04* (2013.01); *B65B 7/02* (2013.01); *B65B 43/123* (2013.01); *B65B 43/14* (2013.01); *B65B 2210/06* (2013.01)

(58) Field of Classification Search

None

See application file for complete search history.

(56) References Cited

U.S. PATENT DOCUMENTS

| | | | | |
|---|---|---|---|---|
| 6,450,215 | B1 * | 9/2002 | Willemstyn | B65B 3/12 141/237 |
| 2020/0130877 | A1 * | 4/2020 | Concetti | B65B 43/30 |
| 2021/0078738 | A1 * | 3/2021 | Witt | A61J 1/10 |
| 2021/0155507 | A1 * | 5/2021 | Kamen | B65B 31/02 |

* cited by examiner

*Primary Examiner* — Tanzim Imam

(74) *Attorney, Agent, or Firm* — Bamert Regan PLLC

(57) ABSTRACT

Embodiments are directed toward an aseptic bag filling system. In some embodiments, the aseptic bag filling system selectively and aseptically fills sterilized bags with a fluid. The bags are dispensed from a magazine that stores the bags while the bags are fluidly coupled to a fluid manifold via respective fluid pathways. The bags define a closed system, the interior of which, after sterilization, is not exposed to the external environment through filling of the bags with the fluid, sealing such filled bags, and separating or cutting such sealed bags from the manifold.

8 Claims, 10 Drawing Sheets

RAPID BAG FILLING SYSTEM

CROSS REFERENCE TO RELATED APPLICATION

This non-provisional application claims the benefit of co-pending non-provisional application Ser. No. 18/959,481, filed Nov. 25, 2024, titled Rapid Bag Filling System, which claims priority to provisional application Ser. No. 63/602,869, filed Nov. 27, 2023, the entirety of each of which are hereby incorporated herein by reference.

FIELD OF THE INVENTION

The invention relates generally to filling bags containing a fluid and, more particularly, to aseptic filling of a plurality of bags with sterile fluid.

BACKGROUND OF THE INVENTION

Bags containing sterile fluid for injection into human (or animal) bodies or to be used as a compound in a mixture to be injected into such bodies must be aseptically filled to avoid infection. Intravenous (IV) bags, for example, contain a fluid, a medication, or a nutrient to be intravenously injected into a patient and are used in a variety of medical patient treatment procedures. One skilled in the art appreciates the critical importance of maintaining the sterility of the IV fluid prior to, and during use of, an IV bag that contains the sterile IV fluid. Of particular difficulty is ensuring sterility of the fluid bags during filling of the bag with the sterile fluid.

Ordinarily, such bags must be filled in a sterile cleanroom, which requires significant dedicated space, a steep learning curve to implement, and meticulous processes to maintain, including strict processes that the human operators must follow to enter and work within the cleanroom. Pharmaceutical-grade isolator and barrier systems also provide a safe and controlled sterile environment that enables filling of sterile bags with sterile fluids. However, isolator and barrier systems are relatively large, and therefore require a large-sized enclosure to house the isolator and barrier system. Further, such isolator and barrier systems, and their attendant enclosure, are very expensive to acquire and maintain. Also, the interior of the isolator and barrier system must be regularly sterilized to ensure that the environment for filling the bags remains sterile during subsequent filling processes, which carries risks because the sterilization process may be imperfect. In an event of a breach in the isolator and barrier system, all products residing within the isolator and barrier system at the time of breach must be destroyed or otherwise disposed of since product sterility cannot be guaranteed. Another difficulty is that the operators must remain outside of the isolator and barrier system during a production run where many bags are filled with a sterile fluid. Accordingly, an isolator and barrier system is not particularly well suited for filling small bags since such small bags cannot be as easily grasped or manipulated by the operators as larger, traditional IV bags. For these reasons, there is a need in the art for aseptic filling of bags containing fluids to be intravenously injected or to form a compound to be mixed before intravenous injection without the need of a dedicated cleanroom or legacy isolator or barrier system.

Efforts have been undertaken to develop automated aseptic IV bag filling systems, also known as aseptic filling machines. For example, U.S. Pat. No. 9,073,650 (the '650 patent), WO 2202/084422 (the WO '422 Publication), and WO 2202/084425 (the WO '425 Publication) disclose devices for automatically filling multiple IV bags. However, the devices disclosed by the '650 patent, the WO '422 Publication, and the WO '425 Publication concurrently fill a plurality of IV bags in parallel and therefore cannot control precise filling of individual IV bags. These devices also make it difficult to measure the weight of each individual IV bag during filling and therefore confirm the volume of fluid in such bag.

U.S. Pat. No. 11,608,201 (the '201 patent) discloses a system and method for automatically filling a plurality of IV bags in an individual manner using a common fluid manifold constructed of two joined films to define a fluid pathway into each individual IV bag. However, after the filling of an individual IV bag, bag-filling system of the '201 patent employs a complicated nozzle system that separates the joined manifold films so as to accommodate advancement of the fluid manifold for filling of the next IV bag, which is subject to leaks and general unreliability. Moreover, the nozzle system exposes the nozzle and the interior surfaces of the joined manifold films to the environment when connecting such manifold films to the nozzle. The dispensing reel of the '201 patent also leaves the IV bags susceptible to damage before and during the dispensing process. It is also challenging to measure the weight of the individual suspended IV bags of the '201 patent, thereby presenting a challenge to ensure accurate measurement of the volume of fluid dispensed into each bag.

U.S. Patent Publication 2021/0309398 (the '398 Publication) discloses a system and method for automatically filling a plurality of IV bags using a plurality of individually controlled occlusion valves. However, coordinated control of the '398 Publication occlusion valves is relatively complex. The system also requires significant and frequent operator intervention to fill only six or so bags at a time. Similar to the other attempted solutions, the suspended IV bags of the '398 Publication present a challenge to weighing the individual suspended IV bags and thus accurately measuring the volume of fluid therein.

Accordingly, there is a need for an aseptic bag filling system and method that permits aseptic filling of bags without a Grade A cleanroom or an equivalent isolator or barrier system. There is also a need for an aseptic bag filling system and method that is low maintenance. There is a further need for an aseptic bag filling system and method that requires little or no human operator involvement during the bag loading, filling, and dispensing process. There is also a need for an aseptic bag filling system and method that enables precise filling of individual bags, such as individually weighing each bag and controlling the volume of fluid dispensed into each respective bag on an individual-bag basis. There is further a need for an aseptic bag filling system and method that prevents exposing the bags, tubing, connectors, or nozzles from being exposed to the environment, thereby enabling use in a non-aseptic environment. There is also a need for an aseptic bag filling system and method that is simple to operate and maintain. Satisfying these needs, individually or in combination, are the objects of the present invention.

BRIEF DESCRIPTION OF THE DRAWINGS

It is therefore an object of the present invention to enable aseptic bag filling without a Grade A cleanroom or an equivalent isolator or barrier system.

It is also an object of the present invention to enable aseptic bag filling that achieves the above object and that also prevents exposing the bags, tubing, connectors, or nozzles from being exposed to the environment, thereby enabling use in a non-aseptic environment.

Figure 1:
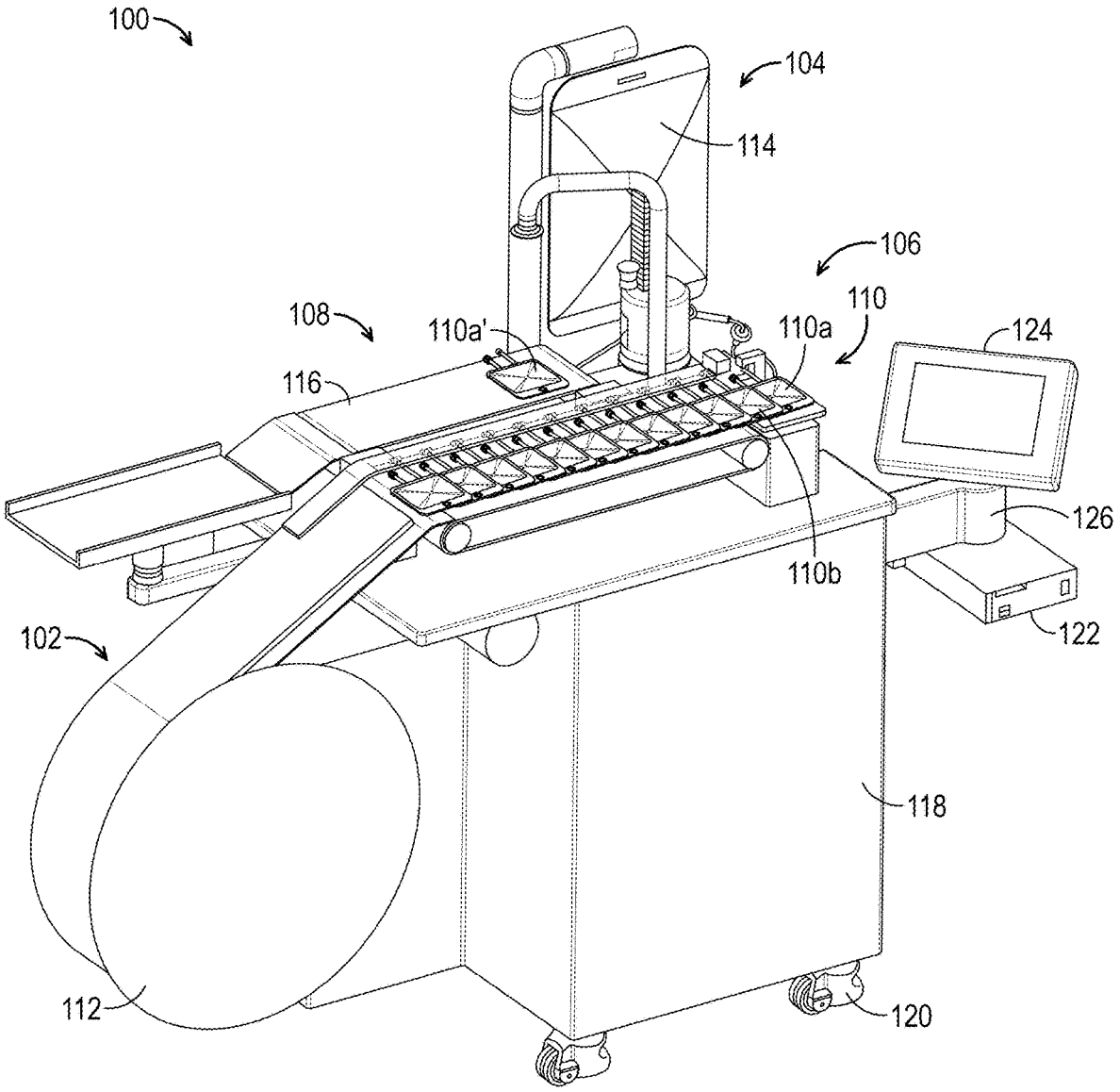

It is another object of the present invention to enable aseptic bag filling that achieve the above objects and that also is simple to operate and maintain.

The invention achieves the above objects, as well as other objects and advantages that will become apparent from the description that follows, by providing an aseptic bag filling system. The system has a bag filling station, a bag feeder system, and in some embodiments a processor system. The bag filling station selectively fills the bags with fluid. The bag feeder system transports an unfilled second bag from a magazine to the bag filling station. The magazine stores unfilled, sterilized bags. The bags in the magazine are fluidly coupled to a fluid manifold via respective fluid pathways. The bags are arranged along the fluid manifold, and the bags define a closed system. The interior of the closed system, after sterilization, is not exposed to the external environment through filling of the bags with the fluid, sealing such filled bags, and separating or cutting such sealed bags from the fluid manifold after filling of each bag.

The processor system is controllably coupled to the bag filling station and the magazine bag feeder system. The processor system has memory and one or more processors. The memory stores instructions that, when executed by the one or more processors, cause the one or more processors to perform actions. Those actions include causing the bag filling station to fill the first bag, causing the magazine bag feeder system to transport a second bag to the bag filling station, and causing the bag filling station to fill the second bag after the second bag has been transported by the magazine bag feeder system to the bag filling station.

In some embodiments, the bag filling station aseptically fills the bags outside of a Grade A cleanroom, without an isolator system surrounding the sterilized bags while filling the bags, and without a barrier system surrounding the sterilized bags while filling the bags.

The filling system also includes, in some embodiments, a bag sealing system that selectively seals the respective fluid pathways and that selectively severs the respective pathways to separate selected bags from the fluid manifold after the fluid pathway of the selected bag is sealed. In some embodiments, the bag sealing system has an upper member and a lower member. Those members receive the fluid pathways, typically one at a time. At least one of the upper member or the lower member selectively pinches the respective pathways to fluidly disconnect a selected bag from the manifold.

In some embodiments, the filling system further includes a first heat sealer element and a second heat sealer that receive the respective fluid pathways, typically one at a time. The first heat sealer element and the second heat sealer element selectively heat seal the respective fluid pathways after it has been pinched by the upper member and the lower member. In some embodiments, a blade is disposed between the first heat sealer element and the second heat sealer element and cuts the heat sealed first fluid pathway.

In some embodiments, the filling system has a magazine bag feeder system that holds the magazine. The magazine bag feeder system in some embodiments has a protection layer reel and a protection layer reel motor that rotates the protection layer reel. In some embodiments, the bags are initially provided to the aseptic bag filling system in a roll in the magazine. The layers of the roll are in some embodiments separated from each other by a protection layer. In some embodiments, the protection layer reel couples to a distal end portion of the protection layer. In some embodiments, the protection layer reel motor rotates the protection layer reel so that the protection layer is spooled onto and is retained on the protection layer reel as the protection layer exits the magazine bag feeder system.

In some embodiments, the magazine bag feeder system has a magazine motor that rotates the roll of bags in the magazine. In some embodiments, the magazine motor and the protection layer reel motor spool the protection layer onto the protection layer reel. In some embodiments, the magazine motor and the bag feeder system serially transport each of the sterilized bags to the bag filling station. In some embodiments, the bag feeder system has a conveyor belt and at least one conveyor belt motor. The magazine motor and the at least one conveyor belt motor in some embodiments rotate in a stepwise manner to advance the second bag into the filling position of the bag filling station.

In some embodiments, the bag feeder system is located operatively upstream of the bag filling station. In some embodiments, the bag feeder system has a manifold tube pincher with an upper pinch member and a lower pinch member that receive a portion of the manifold between the first bag and the second bag prior to the filling of the first bag. In some embodiments, at least one of the upper pinch member or the lower pinch member pinch the portion of the manifold to fluidly disconnect a first portion of the manifold coupled to the first bag from a second portion of the manifold coupled to the second bag. In some embodiments, while the first bag is being filled, no fluid enters into the second bag via the second portion of the manifold.

In some embodiments, the aseptic bag filling system has a magazine that stores unfilled, sterilized bags. The magazine has a body that protects the bags. The magazine facilitates serially dispensing the bags from the magazine to the bag filling station. Each of the bags in the magazine are fluidly coupled to the fluid manifold via respective fluid pathways. Accordingly, the magazine facilitates automated dispensing of the sterilized bags during a process of aseptically filling the sterilized bags.

In some embodiments, the magazine has a rotatable core that is rotatable relative to the magazine body. The unfilled bags in the magazine are in some embodiments arranged in a roll around the core. In some embodiments, the rotatable core operatively couples to a magazine motor that rotates the roll of bags relative to the magazine body to dispense the unfilled bags from the magazine body to the bag filling station.

In some embodiments, the roll of unfilled bags in the magazine has at least two layers. The layers of the roll are in some embodiments separated from each other by a protection layer. In some embodiments, the protection layer is arranged to couple to the protection layer reel that spools the protection layer onto the protection layer reel while the unfilled bags are dispensed from the magazine body to bag filling station.

In some embodiments, the fluid manifold has a distal end that has an aseptic barrier that has one or more filters. In some embodiments, prior to dispensing the bags from the magazine, the unfilled bags and the aseptic barrier are disposed in a first bag that resides inside the magazine while the magazine is disposed inside a second bag. In some embodiments, the contents of the first bag have been sterilized before the second bag receives the magazine.

A method of aseptically filling a plurality of sterilized bags using an aseptic bag filling system includes providing the magazine, coupling a distal end portion of the manifold to the bag filling station; and dispensing the bags from the magazine to the bag filling station. In some embodiments, the method includes filling a first one of the bags with the fluid through the manifold while at least another of the bags remains coupled to the manifold and unfilled in the magazine.

BRIEF DESCRIPTION OF THE DRAWINGS

The preferred embodiment of the present invention is described in detail below with reference to the following drawings.

FIG. 1 is an isometric perspective view of an aseptic intravenous bag filling system.

Figure 2:
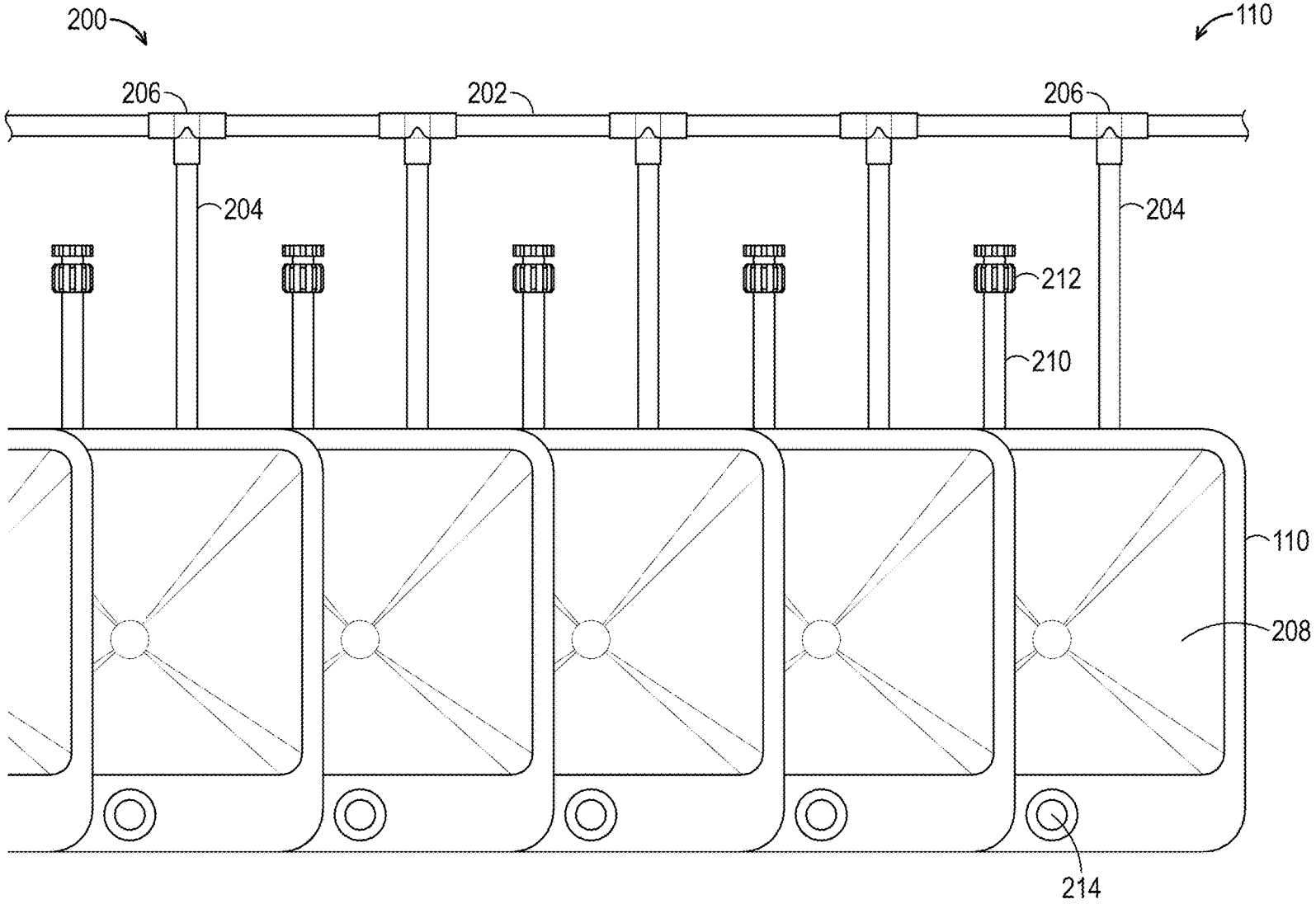

FIG. 2 is a view of a portion of a plurality of unfilled bags to be filled by the aseptic bag filling system of FIG. 1.

Figure 3:
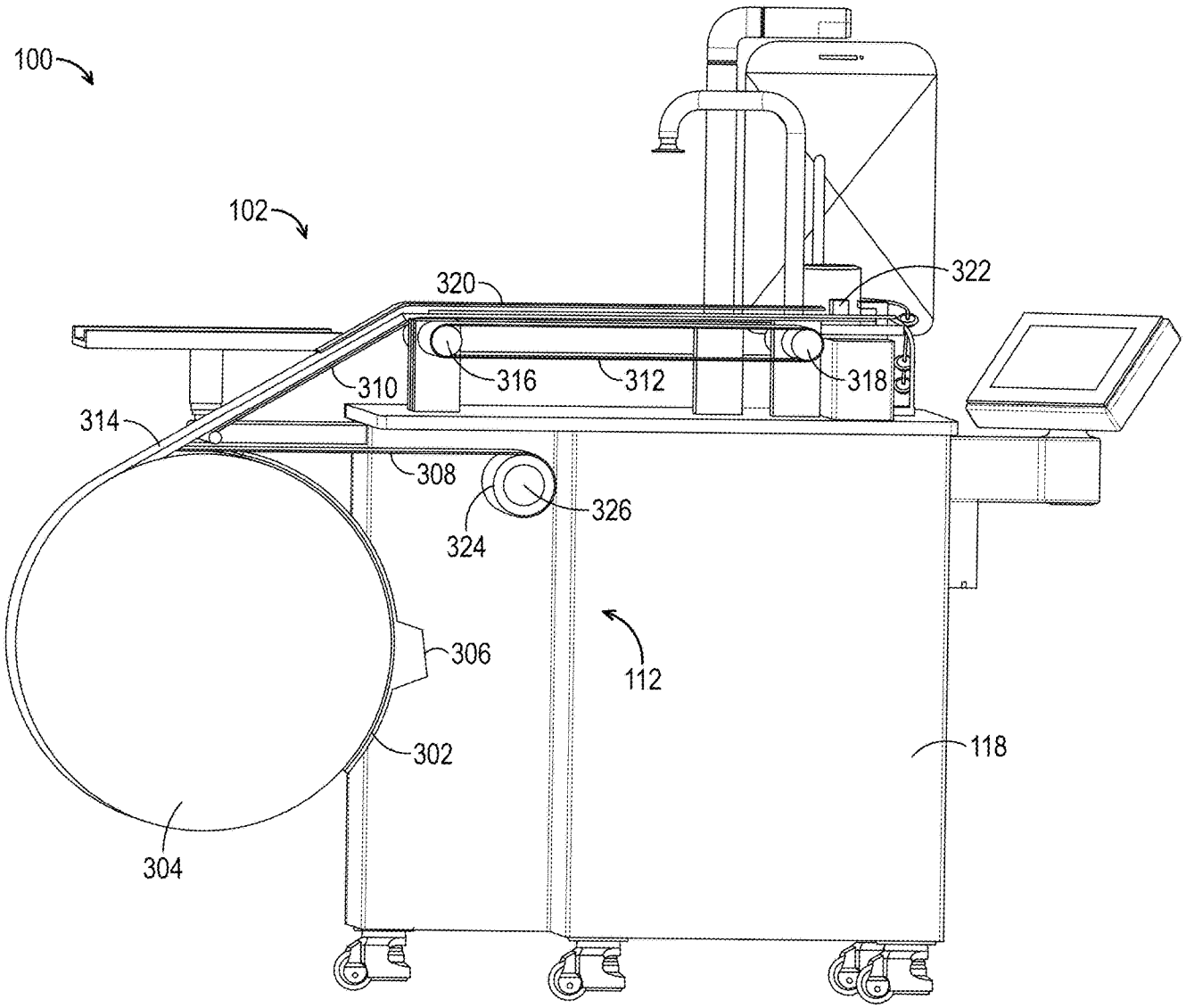

FIG. 3 is a front elevational view of the aseptic bag filling system of FIG. 1 that more clearly illustrates a bag feeder system thereof.

Figure 4:
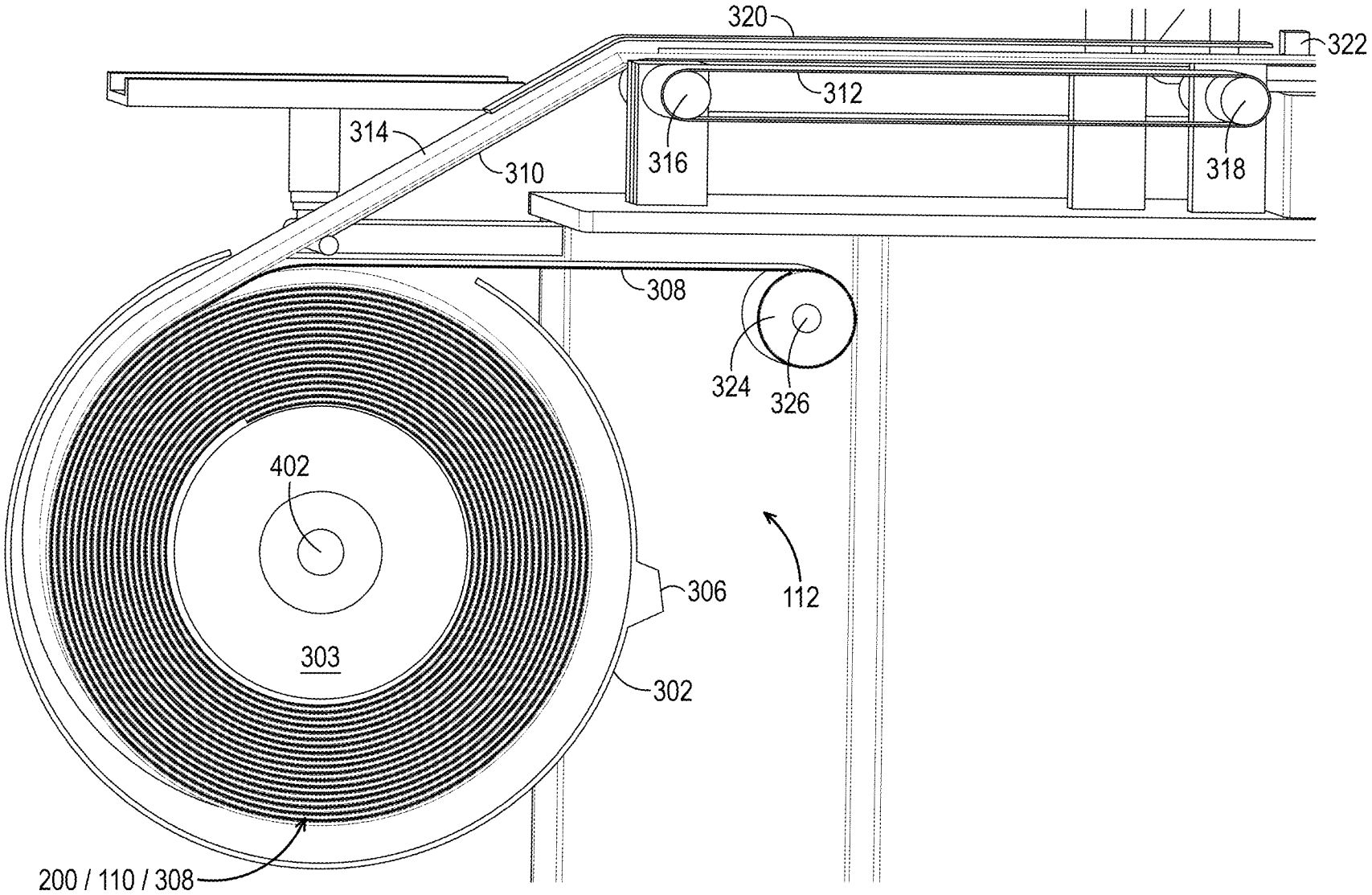

FIG. 4 is a partial cutaway front elevational view of the bag feeder system of FIG. 3 that more clearly illustrates the interior of a drum system thereof and a plurality of unfilled bags residing within the drum system.

Figure 5:
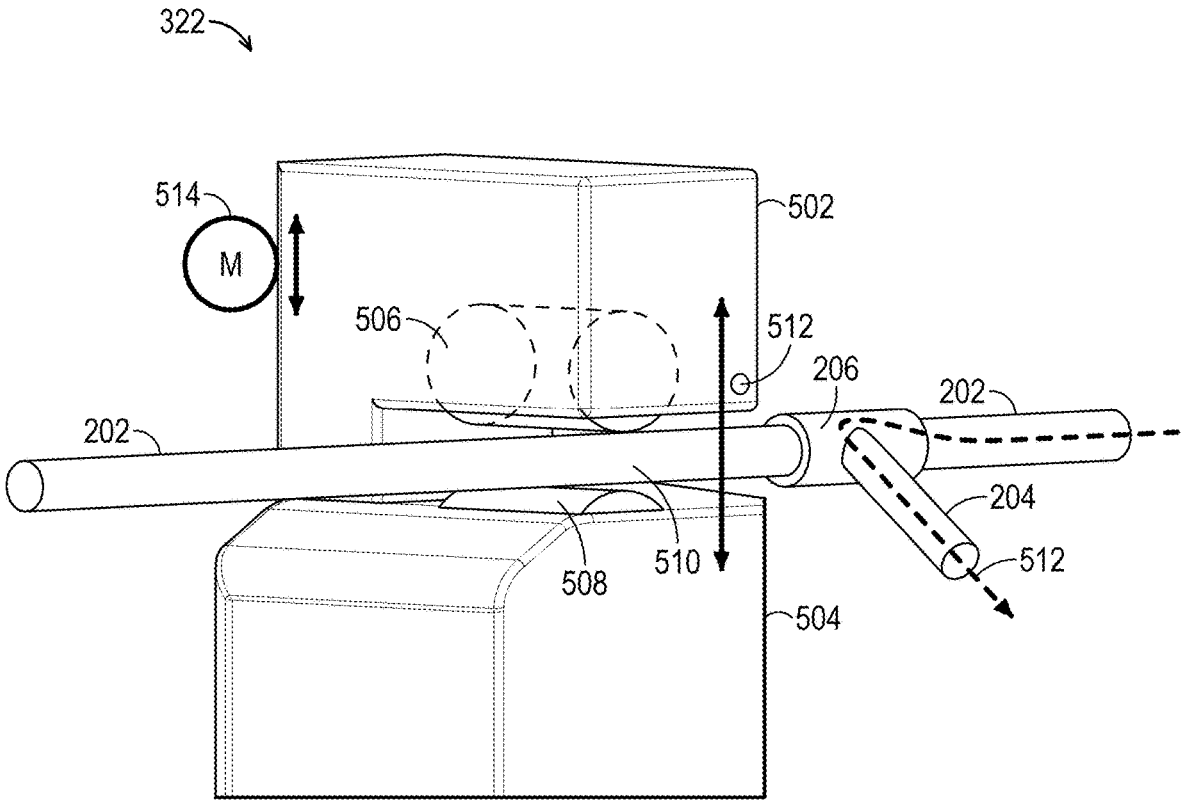

FIG. 5 is an isometric perspective view of a manifold tube pincher of the bag filling system of FIG. 1.

Figure 6:
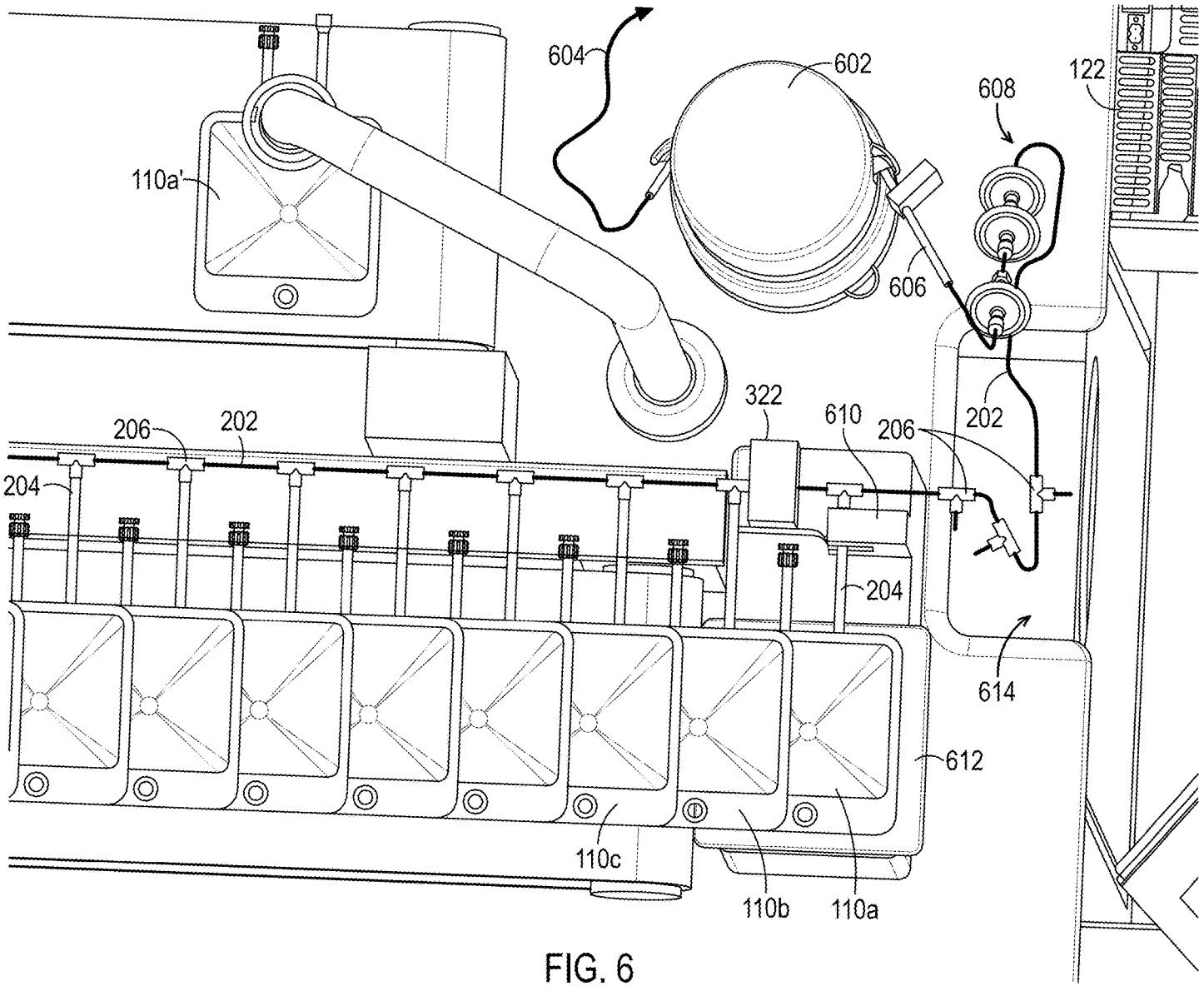

FIG. 6 is an overhead view of the bag filling system of FIG. 1.

Figure 7:
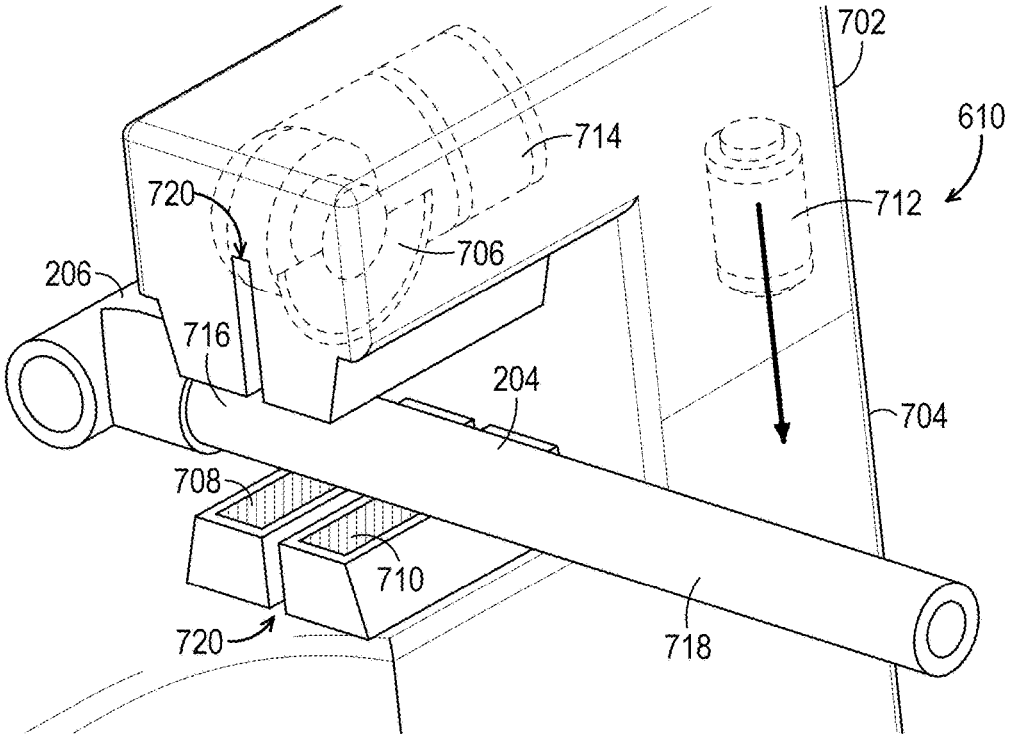

FIG. 7 is an isometric perspective view of a seal and cut system of the bag filling system of FIG. 1.

Figure 8:
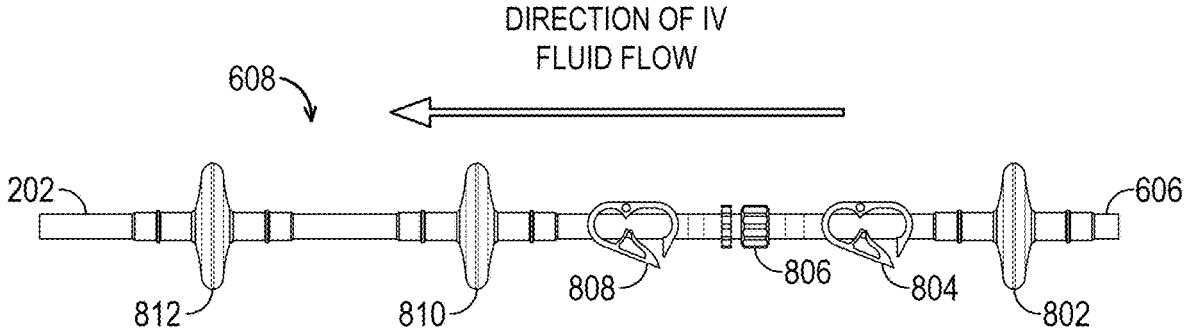

FIG. 8 is an elevational view of a filtration system of the bag filling system of FIG. 1.

Figure 9:
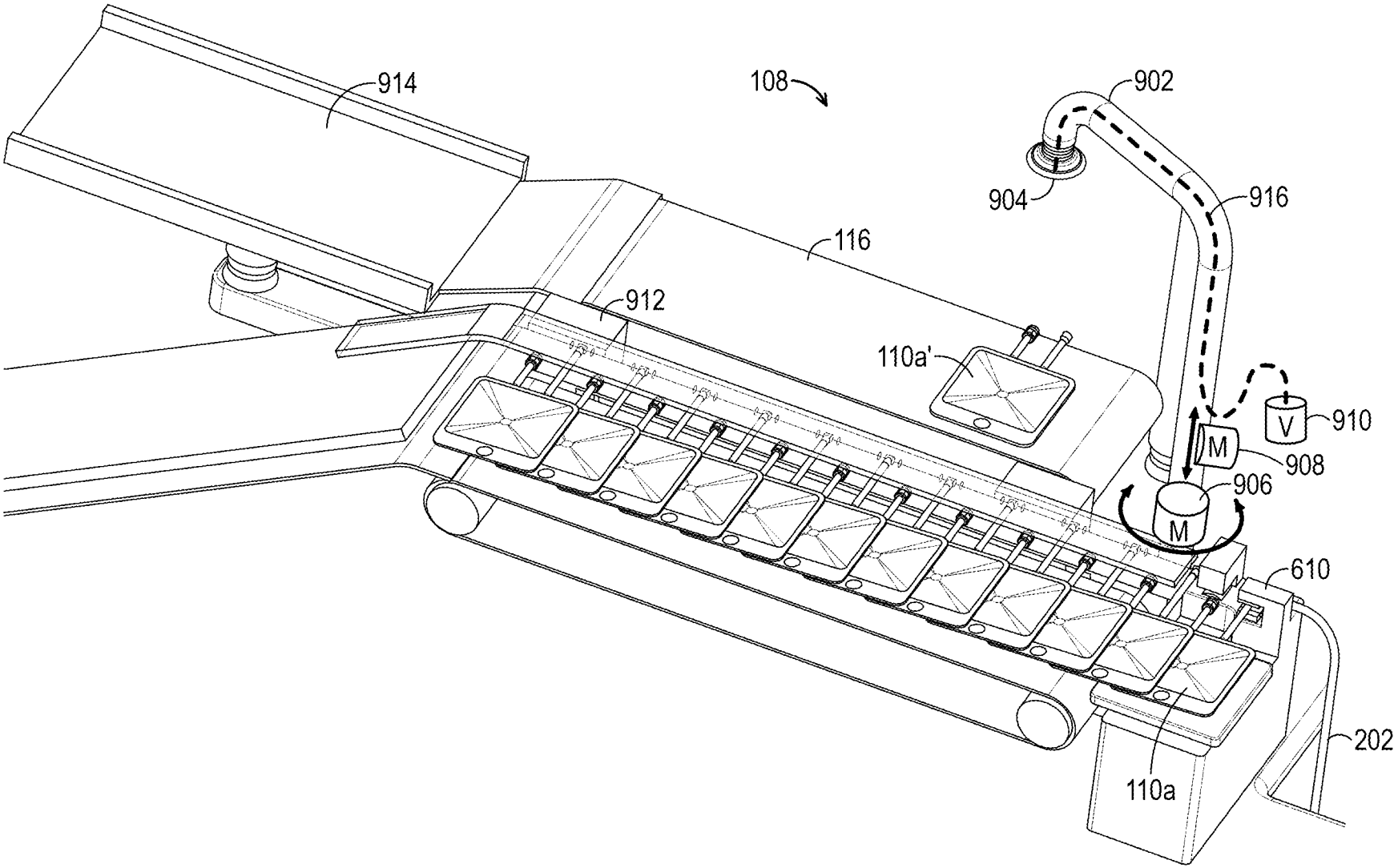

FIG. 9 is an isometric perspective view of a portion of the bag filling system of FIG. 1, including a filled bag transport system thereof.

Figure 10:
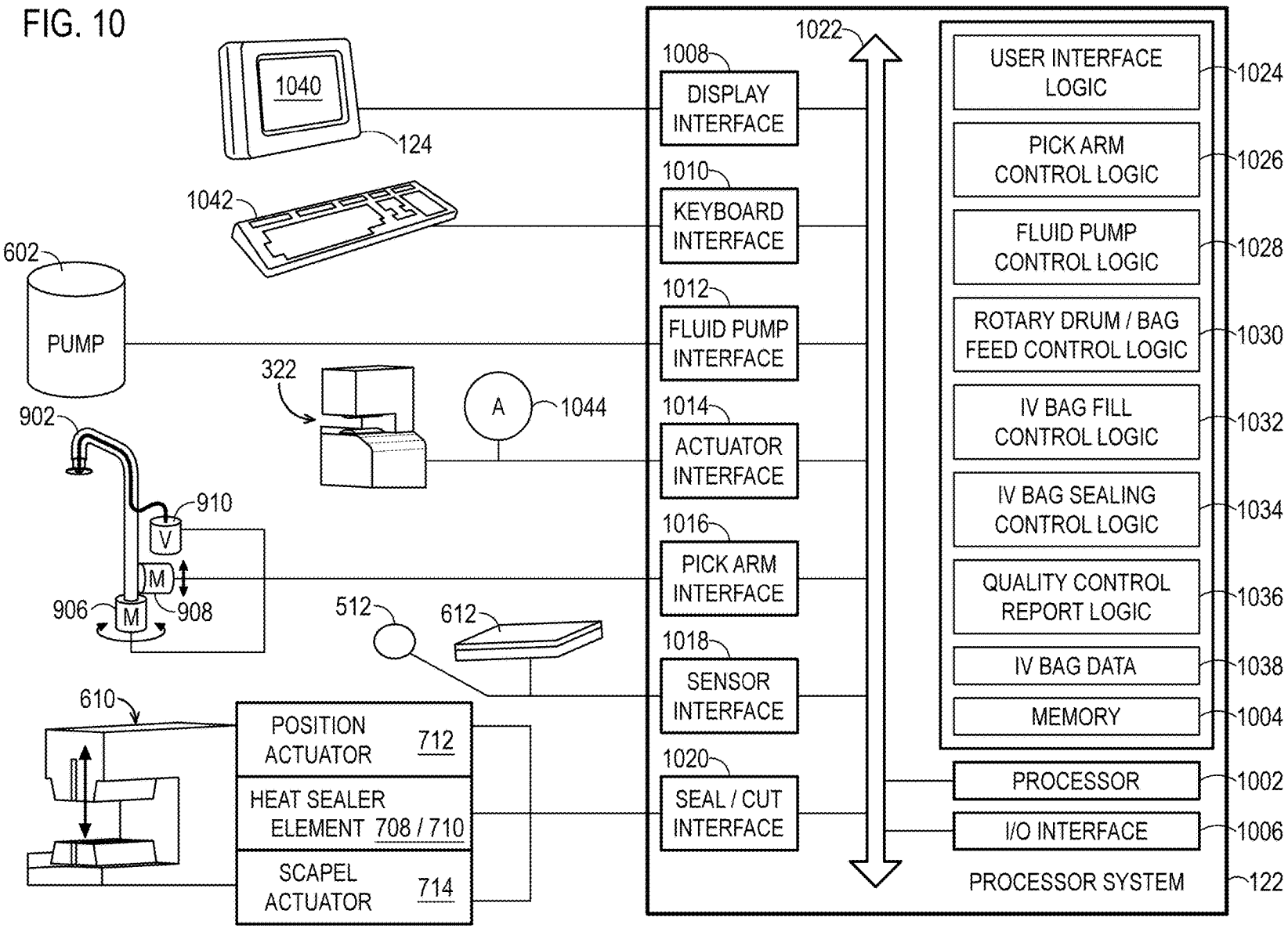

FIG. 10 is a block diagram of selected electronic components of the aseptic bag filling system of FIG. 1.

Figure 11:
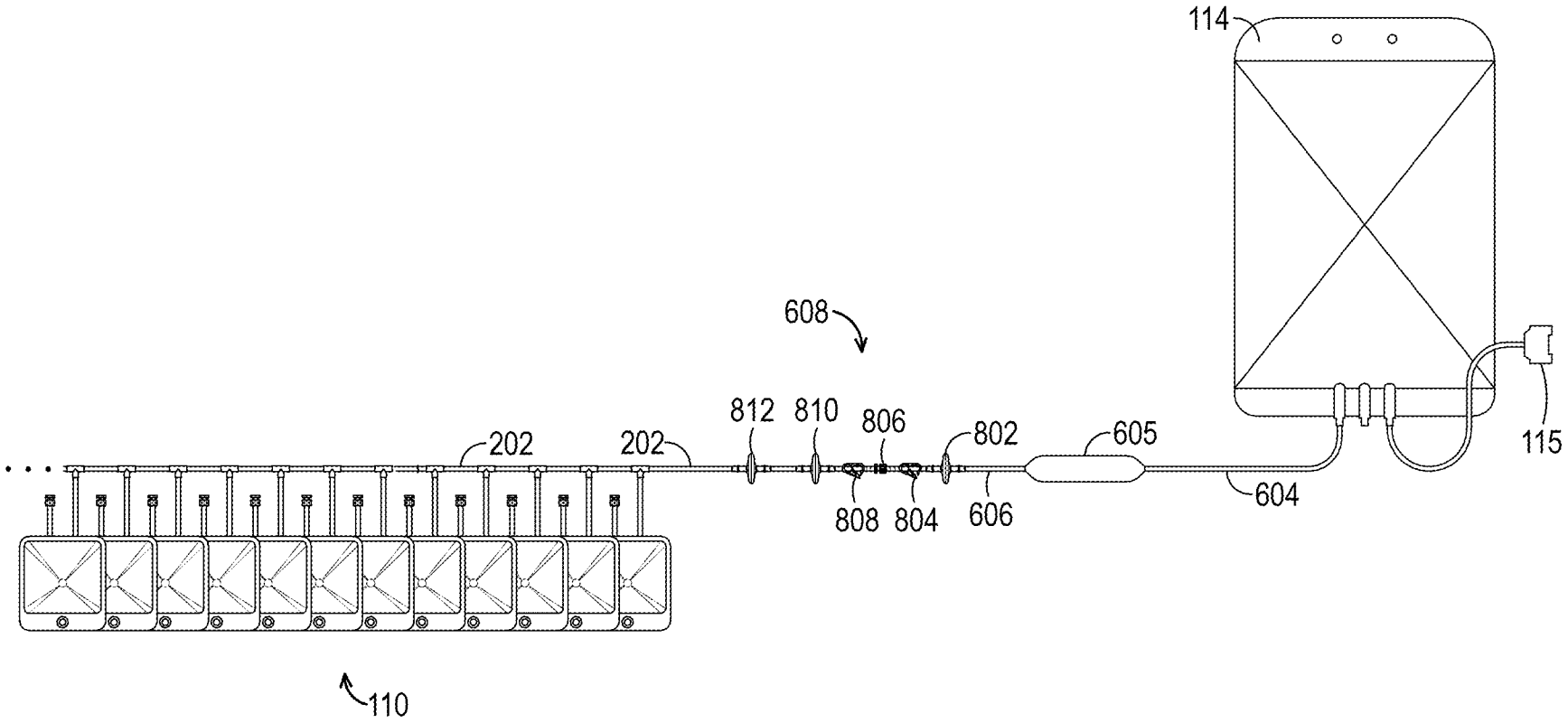

FIG. 11 is a view of a plurality of fluid bags and the manifold fluidly coupled to the surge bag via an aseptic coupling system.

DETAILED DESCRIPTION OF THE PREFERRED EMBODIMENT

An aseptic bag filling system in accordance with the principles of the invention is generally indicated at reference number 100 in the various figures of the attached drawings wherein numbered elements in the figures correspond to like numbered elements herein.

FIG. 1 shows the aseptic bag filling system 100, such as an aseptic intravenous (IV) bag filling system, including one or more of a bag feeder system 102, a bag filling system 104, a bag sealing system 106, a filled bag transport system 108, or a magazine or drum bag feeder system 112. The aseptic bag filling system 100 enables filling a plurality of bags 110, such as intravenous (IV) bags or other aseptic fluid bags, aseptically in a non-aseptic environment without a Grade A cleanroom, Class 1 cleanroom, or an equivalent isolator or barrier system. When the bags 110 are filled with a sterile fluid, the aseptic bag filling system 100, interchangeably referred to herein as the bag filling system 100 or as the system 100 for brevity, may be located in a lower grade cleanroom, such as a Grade D cleanroom or a Class 10 cleanroom.

The plurality of bags 110 are shown as intravenous (IV) bags for illustrative purposes, but some embodiments of the bag filling system 100 are configured to aseptically fill other types of fluid bags 110 that are fluidly coupled to a common manifold as described herein. In some embodiments, the fluid bags 110 are aseptically filled by the system 100 with sterile fluid that is injected into humans (or other animals) or that includes a compound to be mixed with other fluids that, as a mixture, is injected into humans (or other animals).

In some embodiments, the bag feeder system 102 retrieves the plurality of unfilled bags 110 from the drum bag feeder system 112, which houses and dispenses sterile bags 110 in a magazine body such as a drum body. In some embodiments, the drum bag feeder system 112 and the bag filling system 104 cooperatively advance each of the plurality of unfilled bags 110 in a serial manner to the bag filling system 104. The bag filling system 104 fluidly communicates a sterile fluid residing in a surge bag 114 in a leading one of the unfilled bags 110*a*. After the leading bag 110*a* has been filled, the bag sealing system 106 seals the filled bag 110*a* and then severs the filled bag 110*a* from a fluid manifold 202 (see FIG. 2) that commonly couples the unfilled bags 110. In some embodiments, an optional filled bag transport system 108 then picks the filled bag 110*a* and moves it to an optional filled bag conveyor 116 (conceptually illustrated with filled bag 110*a*' in FIG. 1). Then, in some embodiments, the bag feeder system 102 advances the next unfilled bag 110*b* to the bag filling system 104 so that the bag 110*b* can be filled. The process then repeats until the period for filling bags terminates (e.g., end of a workday) or the bags 110 are all filled. The bags 110 are filled from the surge bag 114 through a fluid pathway coupling system 608 (described in further detail below). Accordingly, the system 100 facilitates reliable, automatic filling a plurality of bags 110 aseptically in a non-aseptic environment without a cleanroom or an isolator or barrier system.

As shown in FIG. 1, the illustrated embodiment of the aseptic bag filling system 100 includes a cabinet 118 that supports the various systems. The cabinet 118 optionally provides storage. The cabinet 118 may include moving means 120, such as wheels, rollers, or the other mechanisms for selective positioning of the aseptic bag filling system 100 within a filling room.

The illustrated embodiment includes an optional processor system 122 that controls the various electronic components of the system 100, including one or more of the bag feeder system 102, the bag filling system 104, bag sealing system 106, the filled bag transport system 108, the drum bag feeder system 112, or other optional controllable systems. An optional display 124 is preferably provided to indicate various information of interest to an operator, e.g. a human technician, who is managing the filling process. In the illustrated embodiment, the processor system 122 and the display 124 are secured to the cabinet 118 by an outwardly extending arm 126. In other embodiments, the processor system 122 or the display 124 is located in other locations, either locally or remotely.

FIG. 2 is a view of a portion of the plurality of unfilled bags 110 prior to processing by the aseptic bag filling system 100. The plurality of unfilled bags 110 are serially arranged and spaced apart in a substantially flat row 200 because the bags 110 are initially unfilled. This flat row 200 of unfilled, spaced apart bags 110 are preferably processed in a serial fashion in the conveyor system of the aseptic bag filling system 100. As described in greater detail herein, the flat row 200 of unfilled, spaced apart bags 110 is, in some embodiments, initially provided in a roll that is preferably placed into or otherwise inserted into the cylindrical drum 302 (FIG. 3) of the drum bag feeder system 112 (FIG. 1). The drum bag feeder system 112 preferably then unwinds the roll of unfilled, spaced apart bags 110 to transport them through the aseptic bag filling system 100 so that the leading bag 110 in the row 200 of unfilled bags 110 is filled as described herein.

Each individual one of the unfilled bags 110 is fluidly coupled to a fluid manifold 202 by a respective fluid pathway 204. The fluid manifold 202 extends along the length of the flat row 200 of unfilled, spaced apart bags 110. In some embodiments, each of the fluid pathways 204 are fluidly coupled to the fluid manifold 202 using a T-coupler 206. The fluid manifold 202 and the fluid pathway 204 cooperatively provide a fluid path for sterile fluids to be transported from the surge bag 114 into an inlet of a fillable body portion 208 of each of the unfilled bags 110. Sterile fluids transported into the bag 110 are retained within the fillable body portion 208 until later use by a medical practitioner.

Each of the unfilled bags 110 includes an outlet coupled to an outwardly extending fluid discharge path 210 that includes a sealing cap 212 at a distal end of the fluid discharge path 210. The sealing cap 212 prevents escape of the fluid from the respective one of the bags 110 during the filling process and prior to use of the bag 110. After filling and during use, a filled bag 110 is preferably suspended from an optional aperture 214 so that the fluids are preferably expelled through the discharge path 210 and the sealing cap 212 so that the fluid may be injected into a patient. The sealing cap 212 preferably includes any suitable sealer means that is configured to fluidly couple the bag 110 to a fluid transport line. In some embodiments, the sealing cap 212 is a connector of a luer lock fitting.

In some embodiments, one or more of the components of the serially arranged bags 110 or the sections of the manifold 202 are zip-tied to their respective T-couplers 206. As shown in FIG. 2, the T-couplers 206 each receive two sections of the manifold 202 and a fluid pathway 204 in the respective openings of the T-coupler, and such openings of the T-coupler are tightened onto those received components by zip-ties, thereby securing such components in the T-coupler. In other embodiments, the T-couplers 206 may include softer, moldable or weldable plastics that enable overmolding or welding (e.g., heat welded) the T-couplers to the various sections of the manifold 202 or the fluid pathways 204 to define the manifold 202 and the fluid pathways 204 as a unitary structure that omits such zip-ties.

FIG. 3 more clearly illustrates the bag feeder system 102 and the drum bag feeder system 112. FIG. 4 more clearly illustrates the interior of the drum bag feeder system 112 and a plurality of unfilled bags 110 residing within the drum system 112 according to some embodiments.

In some embodiments, the drum bag feeder system 112 includes a cylindrical drum 302, interchangeably referred to herein as a drum body 302, that defines a housing configured to receive and dispense the roll of sterilized bags 110 and the adjacent protection layer 308. The cylindrical drum 302 includes an optional drum cover 304 (see FIG. 1). A core 303 is defined within the body of the cylindrical drum 302 around a center of the cylindrical drum 302. The core 303 is configured to operatively couple to a motor 402 and rotate the roll of the sterilized bags 200 and the adjacent protection layer 308 relative to the body of the cylindrical drum 302 and facilitates automated dispensing of the sterilized bags 110 to a 402 in a process of filling the sterilized bags 110 in a serial manner at the bag filling system 104 (FIG. 1). In some embodiments, the drum 302 is coupled to the cabinet 118 by an optional drum attachment member 306. The drum attachment member 306, in some embodiments, releasably fixes the exterior of the drum 302 in a predefined position relative to the cabinet 118.

Residing within the drum bag feeder system 112 is a roll of a plurality of unfilled bags 110 (see also FIGS. 1 and 2), at least until such bags 110 have been removed during a production run. During installation of the roll of the unfilled bags 110, the unfilled bags 110 are placed on top of a protection layer 308. The protection layer 308 is a flexible or semi-flexible sheet or film that separates and that protects the layers of rolled unfilled bags 110 from each other. Accordingly, the intermediate protection layer 308 shields the layers of bags 110 from each other and, in some embodiments, the zip-ties of the various layers, thereby preventing scratching or puncture of the various components of the bags and thus preserving the sterile quality of the bags 110. The protection layer 308 also facilitates avoiding entanglement of the unfilled bags 110 as they are serially drawn out of the drum 302.

In some embodiments, the roll of unfilled bags 110 and the protection layer 308 are optionally secured in a sealed bag or other suitable container. Prior to transport to the filling site where the aseptic bag filling system 100 resides, the roll of unfilled bags 110 with two filters that include a primary filter and a redundant filter, which in combination define an aseptic barrier, coupled to the roll of bags 110 (as described in further detail below) is sterilized (e.g., sterilized by gamma radiation). In some embodiments, the unfilled sterilized bags 110 are optionally wrapped with the protection layer 308 around the center core 303 of the drum 302 with the filters being disposed on the end portion of the string of bags 110 that defines the exposed portion of the roll of bags 110 in the drum 302 and thus the aseptic barrier. The bags 110 in the drum, in some embodiments, are optionally wrapped in an inner bag. In some embodiments, the bags 110 are then enclosed in the drum by the drum cover 304, and the drum 302 is optionally wrapped in an outer bag with an optional certificate in the outer or inner bag indicating that the bags 110 and the aseptic barrier (e.g., two or more filters) of the fluid path coupling system 608 (FIGS. 6 and 11) have been sterilized. The bagged drum 302 is then transported to the filling site. Immediately prior to use, an operator may remove the drum 302 from the outer bag and the inner bag from the drum 302. The operator may then releasably secure the drum to the attachment member 306. Then the operator then draws out the first one of the plurality of unfilled bags 110 from the drum bag feeder system 112, and places the first bag 110 into the entrance area of the bag feeder system 102 (see FIG. 1). The operator may then feed the first one of the unfilled bags 110 through the bag feeder system 102 to the bag sealing system 106 and couples the filters to the third filter, which together define the fluid path coupling system 608 (see FIG. 6), thereby coupling the manifold 202 and the plurality if bags 110 to the surge bag 114 without exposing the interiors of the sterile bags 110, the manifold 202, or the filters of the fluid path coupling system 608 to the non-sterile environment in which they will be filled.

In some embodiments, as schematically represented in FIG. 4, an optional drum motor 402 is coupled to or resides in the cabinet 118. The drum motor 407 operatively couples to the core 303 of the drum 302 for example through a belt and axle system or a chain and gear system that rotates an axle on which the drum 302 is installed, and is configured to selectively rotate the drum 302. The drum motor 402 rotates so as to serially feed individual bags in the roll of unfilled bags 110 and the protection layer 308 outwardly from the interior of the drum 302 and toward the bag feeder system 102. In some embodiments, the drum motor 402 operates in a stepwise manner to advance the bags 110 forward by one position or by a predefined length. As the roll of bags 110 is depleted, the amount of angular rotation produced by the drum motor 402 for each bag dispensed from the drum 302 changes in an increasing manner as the radius of the roll of bags 110 decreases to enable advancing the bags 110 by a consistent distance as the number of bags 110 remaining in the drum 302 decreases. In some embodiments, the processor system 122 controls operation of the drum motor 402.

In some embodiments, as shown in FIG. 4, an optional ramp 310 (e.g., a stainless steel ramp) extends from the exit aperture of the drum 302 to an optional conveyor belt 312. As the plurality of unfilled bags 110 are advanced toward the bag filling system 104, each of the unfilled bags 110 and their respective portion of the fluid manifold 204 move out of the drum 302, along the ramp 310, and are then engaged by the conveyor belt 312. An optional ramp cover 314 disposed over the top surface of the ramp 310 is preferably used to guide the unfilled bags 110 as they are transported by the conveyor belt 312 to facilitate laying the bags 110 flat and removing the material memory with respect to a residual tendency to coil caused by being stored in the drum 302 for an extended period of time. In some embodiments, the feed system 102 includes an optional guide member 320 that provides the same function as the ramp cover 314 or is used instead of a ramp cover 314. In some embodiments, the guide member 320 is a polycarbonate cover that is positioned above the upper surface of the conveyor belt 312. The guide member 320 may optionally extend toward or engage the ramp cover 314. The guide member 320 and the upper surface of the conveyor belt 312 are spaced apart by a distance that approximately corresponds to the thickness of the unfilled bags 110, the fluid manifold 204, and the T-joints 208. In some embodiments, the guide member 320 is transparent or partially transparent to enable the operator to view the transporting of the unfilled bags 110 and the fluid manifold 204.

In some embodiments, as shown in FIG. 4, the conveyor belt 312 further advances the unfilled bags 110 toward the bag filling system 104. In the illustrated example embodiment of the bag feeder system 102, one or more conveyor belt motors, such as a first conveyor belt motor 316 and a second conveyor belt motor 318, schematically represented in FIG. 4, are coupled to the cabinet 118 or reside therein and are operatively coupled to the conveyor belt of the feeder system 102 such as through a belt and axle system or a chain and gear system to one or more of the axles about which the conveyor rotates to control the transport of the unfilled bags 110 to the bag filling system 104. The rotation of the drum 302 and movement of the conveyor are typically not continuous because some amount of time is required to individually fill each one of the bags 110 and then seal such bag after filling. Accordingly, the conveyor belt motors 316, 318 operate cooperatively with the drum motor 402 in a stepwise manner to advance the next unfilled bag 110 to the bag filling system 104. In some embodiments, the processor system 122 controls operation of the conveyor belt motors 316, 318.

Alternative embodiments may use any suitable number of conveyor belt motors. Some embodiments may employ other means to transport the unfilled bags 110 to the bag filling system 104. Some embodiments may omit the conveyor belt 312 and simply use a low friction ramp or the like.

As shown in FIG. 4, the operator in practice couples a distal end of the protection layer 308 to an optional protection layer reel 324 during the initial loading process before filling the bags 110. As the protection layer 308 exits the drum 302, the protection layer reel 324 is rotated by an optional protection layer reel motor 326, schematically represented in FIG. 4 and coupled to or residing in the cabinet 118 and operatively coupled to the reel 324 such as through a belt and axle system or a chain and gear system that rotates the axle on which the reel is installed so that the protection layer 308 is spooled or gathered onto the protection layer reel 324. In some embodiments, the processor system 122 controls operation of the protection layer reel motor 326 to operate in stepwise fashion in synchrony with the drum motor 402 and the one or more belt motors 316, 318. In some embodiments, one motor replaces two or more of the drum motor 402, belt motors 316, 318, or reel motor 326 and is geared to provide the degree of rotation to those turned components desired relative to the amount of rotation desired for the other turned components.

FIG. 5 shows a manifold tube pincher 322 of the filling system 104. In the illustrated embodiment, the bag feeder system 102 and the drum bag feeder system 112 cooperatively transport the next unfilled bag 110 to be filled by the bag filling system 104 to a filling position in the bag filling system 104. Advancing the next unfilled bag 110 into the filling position is facilitated by manifold tube pincher 322.

As shown in FIG. 6, the bag filling system 104 in some embodiments includes a manifold tube pincher 322, a pump 602, and a fill level detector 612. In some embodiments, the fill level detector 612 is configured to measure weight of an object, namely the weight of fluid in a filled bag 110.

In some embodiments, the manifold tube pincher 322 includes an upper pinch member 502 and a lower pinch member 504. In some embodiments, an upper roller 506 and a lower roller 508 cooperatively guide the fluid manifold 202, the T-joint 206, and the fluid pathway 204 into position for filling. Some embodiments include a spring-loaded system (not shown) that facilitate the upper roller 506 or the lower roller 508 maintaining contact with and a gripping force on the fluid manifold 202, the T-joint 206, or the fluid pathway 204 of the unfilled bag 110 as it advances into the fill position. In the illustrated embodiment, an optional motorized upper roller 506 resides in the upper pinch member 502. Additionally, or alternatively, the lower roller 508 is motorized. In some embodiments, the rollers 506, 508 rotatably operate in a stepwise manner to advance the next unfilled bag (not shown) to the bag filling system 104 for filling. In some embodiments, the processor system 122 controls operation of the motorized rollers 506, 508 in cooperation with the drum motor 402, belt motors 316, 318, or reel motor 326.

In some embodiments, a sensor 512 (for example, an optical sensor or camera that detects the manifold 202 the T-joints 206, the fluid pathways 204, or markings thereon, a rotational position measurement sensor, or such sensor that provides such information to the processor system 122) provides position information to the processor system 122 corresponding to the detected position of the fluid manifold 202, the T-joint 206, or the fluid pathway 204. Based on the received information, the processor system 122 may actuate one or more of the various motors of the aseptic bag filling system 100 to reposition the fluid manifold 202, the T-joint 206, or the fluid pathway 204 into the correct filling position in the bag filling system 104. During this advancement and positioning process, fluid is typically not being pumped through the fluid manifold 202.

In some embodiments, the upper pinch member 502 is translatable, and the manifold tube pincher 322 includes a motor 514 that translates the upper pinch member 502 in an upward direction or a downward direction. In some embodiments, once the fluid manifold 202, the T-joint 206, the fluid pathway 204, and the unfilled bag 110 are correctly positioned in the bag filling system 104 as shown in FIG. 1, the processor system 122 actuates the motor 514 to move the upper pinch member 502 downward so that the rollers 506, 508 are urged together and thereby cooperatively pinch or compress the portion 510 of the fluid manifold 202 therebetween to form a fluid tight barrier. Here, the manifold 202 is pinched to fluidly disconnect a first portion of the manifold 202 coupled to the first bag 101*a* from a second portion of the manifold 202 coupled to the second bag 101*b*. When the fluid is then pumped into and through the fluid manifold 202, the fluid is diverted into the fluid pathway 204 and then into the bag 110*a* to be filled. Accordingly, fluid is blocked from proceeding to the next bag 110*c* (see FIG. 1).

After the bag 110*a* is filled and sealed, the processor 122 actuates the motor 514 to move the upper pinch member 502 away from the lower roller 508, thereby relieving the pinching of the elastic fluid manifold 202 at portion 510. Accordingly, the drum bag feeder system 112 is now able to advance the next bag 110*b* into the filling position.

Alternatively, or additionally, the lower pinch member 504 is moveable such that the lower pinch member 504 translates upward to pinch the fluid manifold 202 and translates downward to release the fluid manifold. In such an embodiments, an additional motor (not shown) is preferably included to operate the translation of the lower pinch member 504.

FIG. 11 is a view of a plurality of fluid bags 110 and the manifold 202 fluidly coupled to the surge bag 114 via an aseptic fluid path coupling system 608. As shown in FIG. 11, a first fluid line portion 604 fluidly couples pump bridge tubing 605 to the surge bag 104 (see FIG. 1), and a second fluid line portion 606 couples the bridge tubing 605 to the fluid path coupling system 608 (which includes the filters 802, 806 as illustrated in FIG. 8). Prior to use, an outlet of the fluid pathway coupling system 608 is fluidly coupled to an inlet of the fluid manifold 202 while pinch clamps 804, 808 (see FIG. 8) are in the closed or clamped configuration to prevent fluid flow through the lines until the coupling is complete. Preferably, the fluid path coupling system 608, the fluid manifold 202, and the plurality of bags 110 are coupled together and then are sterilized together. The sterilized fluid path coupling system 608, fluid manifold 202, and plurality of bags 110 are preferably placed together in a sterilized enclosure or other packaging, and an optional certificate indicating suitable sterilization is preferably secured to the outside of the enclosure or package. Once the outlet of the fluid pathway coupling system 608 is fluidly coupled to the inlet of the fluid manifold 202, the operator may transition the clamps 804, 808 to the unclamped or open configuration to allow the fluid to flow from the surge bag 114 into the manifold 202. Accordingly, the fluid path coupling system 608, the fluid manifold 202, and the plurality of bags 110 define a closed system that, once sterilized, is never opened to the environment again until dispensing or completion of dispensing the fluid that the system 100 fills into such bags 110.

Prior to use, the operator loads the pump bridge tubing 605 onto the pump 602 (FIG. 6), which compresses the bridge tubing 605 during operation to urge the fluid in the direction of fluid flow shown in FIG. 8. In this way, when a bag 110*a* is being filled after the manifold tube pincher 322 has pinched the portion 510 of the fluid manifold 202 (see FIG. 5), the pump 602 draws sterile fluid out from the surge bag 114, through the fluid pathway coupling system 608, and then into the inlet of the fluid manifold 202. The pumped fluid then flows through the fluid manifold 202, the T-joint 206 immediately preceding the pincher 322, and the fluid pathway 204 coupled to such T-joint into the bag 110*a* that is being filled (since the downstream portion 510 of the fluid manifold 202 has been pinched closed by the manifold tube pincher 322).

In the various embodiments, the surge bag 114 (FIG. 1) is optionally fluidly coupled to a supply reservoir (not shown) that replenishes the surge bag 114 as needed. The surge bag 114 is coupled to the supply reservoir through a sanitary connector 1115 (see FIG. 11), thereby enabling continuously filling the bags 110 until the drum 302 is empty, loading a new drum, and repeating the process without exposing any portion of the fluid path into the bags 110 to the non-sterile environment in which the bags 110 are filled.

When the bag 110*a* to be filled is at the fill level detector 612, a tare weight is taken. As the bag 110*a* is being filled, the fill level detector 612 detects the current amount of fluid being pumped into the bag 110*a* by measuring the change in gross weight detected compared to the tare weight. In some embodiments, information corresponding to the amount of detected fluid is communicated from the fill level detector 612 to the processor system 122. In some embodiments, when the amount of received fluid reaches a predefined threshold, the pumping of fluid is halted by the processor system 122. Accordingly, the amount of fluid pumped into the bag 110 is precisely controlled. In some embodiments, the fill level detector 612 is a scale that measures the weight of the bag 110 and the weight of the received fluid.

FIG. 7 shows a seal and cut system 610 of the sealing system 106 according to some embodiments. The seal and cut system 610, in some embodiments, includes an upper member 702, a lower member 704, a blade 706 such as a scalpel or razor blade, a first heat sealer element 708, and a second heat sealer element 710. In some embodiments, the first heat sealer element 708 and the second heat sealer element are integrated together as a single element. In a preferred embodiment, at least the upper member 702 is configured to translate or move from an upper position (as illustrated in FIG. 7) to a lower position using a motor 712, schematically illustrated in FIG. 7 that is coupled to or in the cabinet 118 and that is operatively coupled to the upper member 702, such as by a belt and axle system or a chain and gear system.

In some embodiments, once the bag 110 has been filled with the predefined amount of fluid, the seal and cut system 610 is actuated by the processor system 122. Actuation of the seal and cut system 610 pinches the fluid pathway 204 by actuating the motor 712, which moves the upper member 702 in a downward direction until the fluid pathway 204 is compressed and thereby pinched closed. The pinching is sufficient to fluidly disconnect the bag 110*a* from the fluid manifold 202. Alternatively, or additionally, the lower member 704 may move upward to pinch the fluid pathway 204.

In some embodiments, after the fluid pathway 204 has been pinched closed, the processor system 122 actuates the first heat sealer element 708 and the second heat sealer element 710. The distal end portion 718 (opposite the proximal end portion 716 that is coupled to the T-joint 206) of the fluid pathway 204 is fluidly sealed from the manifold 202. Accordingly, after sealing, fluid can no longer pass between the fluid manifold 202 and the bag 110*a*.

In some embodiments, after sealing the fluid pathway 204, the processor system 122 actuates a scalpel blade actuator 714. The scalpel blade actuator 714 moves the blade 706 in a downward direction to cut the fluid pathway 204, thereby disconnecting the proximal end portion 716 from the second end portion 718. In some embodiments, the scalpel blade actuator 714 may include a motor driven or pneumatic driven actuator.

In the illustrated embodiments, a slot 720 is disposed in the upper member 702 and the lower member 704 to facilitate movement of the blade 706. In some embodiments, prior to severing the fluid pathway 204, the blade 706 is retracted into the upper member 702. In other embodiments, the blade 706 is moved upward through the lower member 704 to sever the fluid pathway 204. In other embodiments, the blade 706 is moved in a sideways motion through the slot 720 to sever the fluid pathway 204.

Returning to FIGS. 1 and 6, after a filled bag 110*a* is separated from the fluid manifold 202 following sealing, the filled bag transport system 108 moves the filled bag 110*a* away from the filling position in the bag filling system 104. After the filled bag is moved (see bag 110*a*'), the bag feeder system 102 advances the next unfilled bag 110*b* into the filling position for filling with fluid. In some embodiments, the blade 706 is retracted, and the upper pinch member 502 of the manifold tube pincher 322 is moved upward (FIG. 5) prior to advancement of the unfilled next bag 110*b*.

In some embodiments, as the unfilled next bag 110*c* is advanced into the filling position, the portion of the fluid manifold 202 that was previously coupled to the most recently filled bag 110 also advances. Accordingly, in some embodiments, the length of the fluid manifold 202 that has been severed from previously filled bags 110 lengthens during operation. The filled portion of the fluid manifold 202 advances forward and falls into a manifold receptacle 614 of the cabinet 118 (see FIG. 6). Gathering the lengthening fluid manifold 202 portion into the manifold receptacle 614 retains the fluid manifold 202 in a safe location that is free from obstruction of any moving parts of the aseptic bag filling system 100 and unintentional contact with the operator. When the last of the bags 110 has been filled and severed from the fluid manifold 202, the operator may remove the fluid manifold 202 from the manifold receptacle 614 for disposal.

FIG. 8 shows a close-up view of the fluid pathway coupling system 608. In some embodiments, the fluid pathway coupling system 608 includes at least one upstream aseptic filter 802, an upstream tube clamp 804, a connection system such as a lure (luer) fitting 806, a downstream tube clamp 808, and at least one downstream aseptic filter such as the filters 810, 812. Accordingly, in some embodiments, the fluid pathway coupling system 608 facilitates aseptic coupling of the fluid manifold 202 to the surge bag 114 when the operator couples the manifold 202 to the surge bag 114 prior to initialization of the filling process. The tube clamps 804, 806 are typically manual clamps that are preferably manually closed by the operator to allow leak free separation of the male and female portions of the luer fitting when swapping a spent manifold 202 with a manifold 202 of a new drum 302 of bags 110. The operator transitions the clamps 804, 806 to the closed or clamped configuration before disconnecting the manifold 202 from the surge bag 114 and then transitions the clamps 804, 806 to the open or unclamped configuration after connecting a new manifold 202 to the surge bag 114. As explained above, a new or fresh drum 302 full of bags 110 is, in some embodiments, provided with the downstream portion of the fluid pathway coupling system 608, which portion has been sanitized along with the bags 110 in the new drum 302. In this embodiment, the downstream portion of the system 608 is defined by at least one downstream filter (e.g., filters 810, 812), an optional downstream clamp 808, and a luer fitting 806 (e.g., male or female end portion) that couples to the other luer fitting 806 to define the fluid pathway coupling system 608. Accordingly, the system 608 facilitates aseptically filling the sterile bags 110 from the drum 302 in a non-sterile environment without environmental barriers surrounding the filling system or station 104, such as a bio-cabinet, sterile cabinet, cleanroom, or isolator.

In some embodiments, as shown in FIG. 9, the filled bag transport system 108 optionally includes a pickup arm 902, a pickup up device 904, a pickup arm rotation motor 906, a pickup arm translation motor 908, a vacuum pump 910, a filled bag conveyor 116, a conveyor motor 912, or a bag tray 914. In FIG. 9, the motors and pump are illustrated schematically and are typically coupled to or disposed in the cabinet 118 and operationally coupled to the pickup arm 902. In some embodiments, operation of the pickup arm rotation motor 906, the pickup arm translation motor 908, the vacuum pump 910, and the conveyor motor 912 are managed by the processor system 122.

In some embodiments, after the bag 110*a* has been filled and severed from the fluid manifold 202, the pickup arm rotation motor 906 and the pickup arm translation motor 908 are cooperatively actuated to position the pickup up device 904 onto the top of the filled bag 110*a*. In some embodiments, the pickup arm rotation motor 906 rotates the pickup arm 902 so as to position the pickup up device 904 over the filled bag 110*a*. In some embodiments, the pickup arm translation motor 908 moves the pickup up device 904 downwardly until the pickup up device 904 is in contact with the top surface of the filled bag 110*a*. In some embodiments, the pickup up device 904 includes a suction cup type nozzle. In some embodiments, once the pickup up device 904 is positioned on the top surface of the filled bag 110*a*, the vacuum pump 910 is actuated to create a vacuum in a vacuum line 916 that couples the pickup up device 904 (e.g., the suction cup type nozzle) to the vacuum pump 910. In some embodiments, the vacuum secures the filled bag 110*a* to the pickup up device 904.

In some embodiments, after the filled bag 110*a* is secured to the pickup device 904, the pickup arm translation motor 908 moves the pickup up device 904 upwardly until the pickup up device 904 is above the bag feeder system 102 and the bag filling system 104. In some embodiments, the pickup arm rotation motor 906 then rotates the pickup arm 902 so that the pickup up device 904 and the secured filled bag 110*a* are positioned above the filled bag conveyor 116. Then, in some embodiments, the pickup arm translation motor 908 optionally lowers the pickup up device 904 so that the filled bag 110*a* is proximate to or on the surface of the filled bag conveyor 116.

Next, in some embodiments, the vacuum pump 910 is actuated to halt the vacuum such that the filled bag 110 (now conceptually illustrated as the filled bag 110*a*') is released from the pickup device 904. In some embodiments, the pickup arm rotation motor 906 or the pickup arm translation motor 908 are actuated to move the pickup device 904 away from the filled bag 110*a*' which now is resting on the filled bag conveyor 116. In some embodiments, the conveyor motor 912 is then actuated to transport the filled bag 110*a*' toward or into the bag tray 914. In some embodiments, the operator may then pick up and move the filled bag 110*a*', and other filled bags 110 in the tray 914, to a suitable location for further processing. In some embodiments, further automation controls may receive or take the filled bag 110*a*' from or instead of the tray 914.

FIG. 10 is a block diagram of select components of the aseptic bag filling system 100. In some embodiments, the processor system 122 includes a processor 1002, a memory 1002, an input and output (I/O) interface 1006, a display interface 1008, a user input interface 1010 such as a keyboard or touchscreen, a fluid pump interface 1012, an actuator interface 1014, a pick arm interface 1016, a sensor interface 1018, and a seal/cut interface 1020. In some embodiments, one or more of these components are communicatively coupled to the processor 1002 using a system bus 1022. Alternative embodiments may couple the components directly or indirectly to the processor 1002 using other connection means.

In some embodiments, the memory 1004 includes portions for storing the user interface logic 1024, the pick arm control logic 1026, the fluid pump control logic 1028, the rotary drum and bag feed control logic 1030, the bag fill control logic 1032, the bag sealing logic 1034, the quality control report logic 1036, and bag data 1038. In some embodiments, one or more of the logic modules are integrated together or integrated with other logic. In other embodiments, some or all of these memory and other data manipulation functions are provided by using a remote server or other electronic devices suitably connected via the Internet or otherwise to a client device.

In some embodiments, the user interface logic 1024, when executed by processor 1002, receives input from the operator who is operating the aseptic bag filling system 100. In an example embodiment, the display 124 includes a touch sensitive display 1040 that facilitates input from the operator. Alternatively, or additionally, the operator may input information using a keyboard 1042, via the optional keyboard interface 1010. Other input devices are in some embodiments used to provide operator input to the aseptic bag filling system 100. Further, the processor system 122, executing the quality control reporting logic 1036, may provide feedback to the operator by presenting information on the display 124 indicating various performance information pertaining to the bag filling process.

In some embodiments, the processor system 122, executing the quality control report logic 1036, outputs various performance reports indicating various quality control parameters to any suitable output device, via the I/O interface 1006, such as information pertaining to a completed production run that is preferably assembled into a report.

In some embodiments, the processor system 122, executing the fluid pump control logic 1028, generates control instructions that are communicated to the pump 602 via the fluid pump interface 1012. In some embodiments, during the bag filling process, the fill level detector 612, illustrated as a scale 612, provides information corresponding to the amount of fluid that has currently been transported into the bag 110 (e.g., weight). In some embodiments, the information from the scale 612, received via the sensor interface 1018, is used by the processor 122 (while executing the bag fill control logic 1032), to determine the current amount of fluid in the bag 110. In some embodiments, when the current amount of fluid reaches the threshold fluid amount, the processor system 1002 deactivates the pump 602. Accordingly, in some embodiments, the amount of fluid transported by the bag filling system 104 into a filling bag 110 is precisely controlled.

In some embodiments, the processor 1002, executing the bag sealing control logic 1034, operates the components of the bag sealing system 106. In some embodiments, the processor 1002 actuates the position motor 712 to pinch the fluid pathway 204 closed. Then, in some embodiments, the processor 1002 actuates the heat elements 708, 710 to seal the fluid pathway 204. Finally, in some embodiments, the processor system 1002 actuates the scalpel blade actuator 714 to sever the fluid pathway 204. In some embodiments, control signals generated by the processor 1002 are communicated via the seal/cut interface 1020 to the components of the bag sealing system 106.

In some embodiments, after the bag 110 has been filled and severed from the fluid manifold 202, the processor system 122, executing the pick arm control logic 1026, controls operation of the motors 906, 908 and the vacuum pump 910 to pick up and transport the filled bag 110 to the filled bag conveyor 116. In some embodiments, control signals generated by the processor 1002 are communicated via the pick arm interface 1016.

Then, in some embodiments, the processor system 1002, executing the rotary drum and bag feed control logic 1030, controls operation of the component of the bag feeder system 102 and the drum bag feeder system 112 to advance the next bag 110 to the filling position in the bag filling system 104. Here, in some embodiments, controls signals generated by the processor system 1002 are communicated to the various actuators 1044 via the motor interface 1014.

In some embodiments, the various actuators 1044 conceptually illustrated in FIG. 10 generically correspond to the various actuators or motors described herein that are components of the bag feeder system 102, the bag filling system 104, the bag sealing system 106, the filled bag transport system 108, and the drum bag feeder system 112.

In some embodiments, to enable calculating the angular rotation that should be employed by the motor 402 to advance the bags 110 as the roll of bags 110 decreases, dimensions or other information for the various types or sizes of bags 110, the various fluid manifolds 202, and the various T-joints 206 that are preferably filled by the aseptic bag filling system 100 are stored in the bag data 1038 of memory 1004. In some embodiments, the information is stored into the bag data 1038 at any suitable time prior to operation of the aseptic bag filling system 100. In some embodiments, the information is provided locally or remotely. In some embodiments, once the bag dimension information and other relevant information are retrieved from the bag data 1038, the process of filling the bags 110 is initiated. As the individual bags 110 are serially advanced towards the filling position in the bag filling system 104, the information is in some embodiments used by the processor 1002 to determine how to control the various actuators 1044 in a coordinated manner to advance the bags 110 in a stepwise manner.

In some embodiments of the aseptic bag filling system 100, one or more of the interfaces is communicatively coupled to its corresponding controlled device via a suitable wire connector. Alternatively, one or more of the interfaces may employ a suitable wireless connection to the corresponding controlled device.

As used herein, the following terms take the meanings explicitly associated herein, unless the context clearly dictates otherwise. The term "grade" is made in reference to the European cleanroom classifications as defined in Volume 4, Annex 1 of the EudraLex, The Rules Governing Medicinal Products in the European Union, European Communities Commission (Directorate-General for Industry, Pharmaceuticals and Cosmetics). Under the grade scale, Grade A cleanrooms are required for aseptic assembly of filling equipment and aseptic filling and sealing of containers. Also under the grade scale, Grade D cleanrooms are for cleaning equipment, handling components after cleaning, assembly under HEPA filtered airflow of cleaned components prior to sterilization, and assembly of closed and sterilized components using intrinsic sterile connection devices. The term "class" is made in reference to the ISO standard for cleanroom classifications as defined as ISO14644-1:2015. Under the class scale, Class 1 cleanrooms equate to Grade A cleanrooms, and Class 10 cleanrooms equate to Grade D cleanrooms.

The terms "front," "forward," "rear," and "rearward" are defined relative to the cabinet 118. The terms "front" and "forward" indicate the portion of the cabinet 118 facing the viewer of FIG. 3. The terms "rear" and "rearward" indicate the side of the cabinet 118 that is opposite the front of the cabinet. The terms "height," "vertical," "upper," "lower," "above," "below," "top," "bottom," "topmost," and "bottom-most" are defined relative to vertical axis of the cabinet 118. The vertical axis is non-parallel to the longitudinal axis and is defined as parallel to the direction of the earth's gravity force on the cabinet 118 when the cabinet 118 is on horizontal ground. The term "lateral" is defined relative to the lateral axis of the cabinet 118. The lateral axis is non-parallel to the longitudinal and vertical axes. The longitudinal axis of the cabinet 118 extends left to right in FIG. 3.

The term "configured" as used herein means an element being one or more of sized, dimensioned, positioned, oriented, or otherwise arranged to achieve or provide the recited function or result. The term "directly coupled" as used herein means that a component contacts (for example, when bolted) or is welded to another component. The term "indirectly coupled" as used herein means that a first component is coupled to a second component by way of one or more intervening components that are directly coupled to the first and second components. A first component that is indirectly coupled to a second component is directly coupled to a third component, which may be directly coupled to the second component or to a fourth component that is directly coupled to the second component. The term "coupled" should therefore be understood to disclose both direct and indirect coupling of components or elements that are described as being coupled to each other.

The term "or" is an inclusive grammatical conjunction to indicate that one or more of the connected terms may be employed. For example, the phrase "one or more A, B, or C" or the phrase "one or more As, Bs, or Cs" is employed to discretely disclose each of the following: i) one or more As, ii) one or more Bs, iii) one or more Cs, iv) one or more As and one or more Bs, v) one or more As and one or more Cs, vi) one or more Bs and one or more Cs, and vii) one or more As, one or more Bs, and one or more Cs. The term "based on" as used herein is not exclusive and allows for being based on additional factors not described. The articles "a," "an," and "the" include plural references. Plural references are intended to also disclose the singular.

While the preferred embodiment of the aseptic bag filling system 100 has been illustrated and described, as noted above, many changes can be made without departing from the spirit and scope of the invention. Each disclosure of a component preferably having a feature or characteristic is intended to also disclose the component as being devoid of that feature or characteristic, unless the principles of the invention clearly dictate otherwise. Accordingly, the scope of the invention is not limited by the disclosure of the preferred embodiment. Instead, the invention should be determined entirely by reference to the claims that follow. It should also be noted that the claim dependencies or combinations of elements recited in the claims do not reflect an intention to forgo claiming other subject matter disclosed herein. Instead, this disclosure is intended to also disclose the subject matter of any combination of any two or more of the claims, such that subsequent claim sets may recite that any one of the dependent claims depends from any other one or more claims, up to and including all other claims in the alternative (such as "The apparatus or method of any one of the preceding or subsequent claims . . . "). This disclosure is also intended to disclose the subject matter of any one of the dependent claims, as if it was an independent claim, with or without all or a portion of the subject matter of the original independent claim(s) or any other subject matter disclosed herein.

Those of ordinary skill in the art will conceive of other alternate embodiments of the invention upon reviewing this disclosure. Thus, the invention is not to be limited to the above description but is to be determined in scope by the claims that follow.

The invention claimed is:

1. A manifold system configured to fill bags with a fluid, the manifold system comprising:

a manifold having a manifold inlet at a proximal end portion of the manifold and a manifold fluid pathway that extends from the manifold inlet to a distal end portion of the manifold, wherein the manifold includes a plurality of manifold T-joints between the manifold inlet and the distal end portion of the manifold, and wherein the T-joints are spaced along the manifold fluid pathway and are separated from each other by a predefined distance; and a plurality of unfilled sterile bags corresponding to the manifold T-joints, wherein each one of the plurality of unfilled sterile bags is fluidly coupled to a respective one of the manifold T-joints via a respective bag fluid pathway, wherein the manifold inlet includes a manifold coupling means at a proximal end portion of the manifold inlet, wherein the manifold and the plurality of unfilled sterile bags are rolled into a roll and reside in a drum bag feeder system, wherein the drum bag feeder system is configured to be secured to an aseptic bag filling system so that the manifold and the plurality of unfilled sterile bags are dispensable from the drum bag feeder system in a serial manner, and wherein the manifold coupling means is configured to, prior to filling a first one of the plurality of unfilled sterile bags that is proximate to the manifold inlet, releasably couple to a fluid source coupling means located at a distal end portion of a fluid line of a fluid source and transfer fluid from the fluid source through the manifold inlet to each of the sterile bags in a serial manner while the manifold inlet remains coupled to the fluid source coupling means.

2. The manifold system of claim 1, wherein the first one of the plurality of unfilled sterile bags is fluidly coupled to a first one of the manifold T-joints via a first bag fluid pathway, wherein the first one of the manifold T-joints is a closest one of the plurality of manifold T-joints to the proximal end portion of the manifold, wherein a second one of the plurality of unfilled sterile bags sequentially next to the first one of the plurality of unfilled sterile bags and a second one of the manifold T-joints sequentially next to the first one of the manifold T-joints are configured to, after the first one of the plurality of unfilled sterile bags is filled at a filling station and after the first one of the plurality of unfilled sterile bags is separated from the first one of the manifold T-joints, advance into the filling station, and wherein the first one of the manifold T-joints and a corresponding portion of the manifold fluid pathway are configured to, after the first one of the plurality of unfilled sterile bags is separated from the first one of the manifold T-joints, remain in fluid communication with the manifold inlet.

3. The manifold system of claim 1, wherein the manifold coupling means is a first part of a luer fitting, and wherein the fluid source coupling means is a corresponding second part of the luer fitting.

4. The manifold system of claim 3, wherein the first one of the plurality of unfilled sterile bags is fluidly coupled to a first one of the manifold T-joints via a first bag fluid pathway, wherein the first one of the manifold T-joints is a closest one of the plurality of manifold T-joints to the proximal end portion of the manifold, wherein a second one of the plurality of unfilled sterile bags sequentially next to the first one of the plurality of unfilled sterile bags and a second one of the manifold T-joints sequentially next to the first one of the manifold T-joints are configured to, after the first one of the plurality of unfilled sterile bags is filled at a filling station and after the first one of the plurality of unfilled sterile bags is separated from the first one of the manifold T-joints, advance into the filling station, and wherein the first one of the manifold T-joints and a corresponding portion of the manifold fluid pathway are configured to, after the first one of the plurality of unfilled sterile bags is separated from the first one of the manifold T-joints, remain in fluid communication with the manifold inlet while the first part of the luer fitting and the second part of the luer fitting are retained in a manifold receptacle.

5. The manifold system of claim 1, wherein the manifold inlet includes:

at least one manifold inlet fluid clamp; and at least one manifold filter, wherein the at least one manifold inlet fluid clamp is disposed between the manifold coupling means and the at least one manifold filter, and wherein the at least one manifold inlet fluid clamp is configured to be released after the manifold coupling means is releasably coupled to the fluid source coupling means so that fluid flows from the fluid source into the manifold via the at least one manifold filter.

6. The manifold system of claim 1, wherein the manifold inlet includes at least one manifold filter located proximate to the proximal end portion of the manifold inlet that is fluidly coupled to the manifold fluid pathway.

7. The manifold system of claim 6, wherein the first one of the plurality of unfilled sterile bags is fluidly coupled to a first one of the manifold T-joints via a first bag fluid pathway, wherein the first one of the manifold T-joints is a closest one of the plurality of manifold T-joints to the proximal end portion of the manifold, wherein a second one of the plurality of unfilled sterile bags sequentially next to the first one of the plurality of unfilled sterile bags and a second one of the manifold T-joints sequentially next to the first one of the manifold T-joints are configured to, after the first one of the plurality of unfilled sterile bags is filled at a filling station and after the first one of the plurality of unfilled sterile bags is separated from the first one of the manifold T-joints, advance into the filling station, and wherein the first one of the manifold T-joints and a corresponding portion of the manifold fluid pathway are configured to, after the first one of the plurality of unfilled sterile bags is separated from the first one of the manifold T-joints, remain in fluid communication with the manifold inlet while the at least one manifold filter is retained in a manifold receptacle.

8. The manifold system of claim 1, wherein the drum bag feeder system includes a housing configured to receive and dispense the roll of the manifold and the plurality of unfilled sterile bags.

* * * * *